United States Patent [19]

Haney

[11] 4,307,977

[45] Dec. 29, 1981

[54] REMOVABLE MUDMAT AND METHOD OF USE ON SOFT FLOOR

[75] Inventor: James A. Haney, New Orleans, La.

[73] Assignee: McDermott Incorporated, New Orleans, La.

[21] Appl. No.: 152,925

[22] Filed: May 23, 1980

[51] Int. Cl.[3] ..... E02B 17/02

[52] U.S. Cl. ..... 405/227; 405/228

[58] Field of Search ..... 405/195, 211, 224–228, 405/203, 206

[56] References Cited

U.S. PATENT DOCUMENTS

| | | | |
|---|---|---|---|
| 2,318,685 | 5/1943 | Gross | 405/205 |
| 2,940,265 | 6/1960 | Doody et al. | 405/227 |
| 3,064,437 | 11/1962 | Knapp | 405/224 X |
| 3,456,448 | 7/1969 | Luque | 405/224 X |
| 3,496,728 | 2/1970 | Slack | 405/211 |
| 3,512,811 | 5/1970 | Bardgette et al. | 405/227 |
| 3,592,012 | 7/1971 | Mott | 405/227 |
| 3,638,436 | 2/1972 | Pogonowski | 405/227 |
| 4,014,176 | 3/1977 | Weidler | 405/227 X |

*Primary Examiner*—Ernest R. Purser

*Attorney, Agent, or Firm*—Robert J. Edwards; Stephen R. Doody

[57] ABSTRACT

A mudmat and mudmat removal procedure used in combination with an offshore marine structure for supporting said structure on a soft, unconsolidated seafloor during installation of said structure to the seafloor.

26 Claims, 6 Drawing Figures

REMOVABLE MUDMAT AND METHOD OF USE ON SOFT FLOOR

TECHNICAL FIELD

This invention relates to marine structures and, more particularly, to an apparatus for and a method of supporting a marine structure on a soft, unconsolidated seafloor during installation of the structure to the seafloor.

BACKGROUND ART

For many years, man has extracted oil and gas from beneath the earth's surface. Much of the drilling has taken place in the offshore area where large reservoirs have been discovered beneath the world's seabeds. Various types of structures have been employed in these offshore operations. Most structures include a horizontal working platform or deck which is supported at a safe distance above the water's surface by various support devices.

Some support devices consist of floating members which are kept in position by a plurality of judiciously placed anchors. Other support devices are submerged and attached temporarily to the seabed and are capable of being withdrawn and used at other drilling sites. Still other support devices are permanently attached to the seafloor.

One popular arrangement for permanently attaching the structure to the seafloor involves the use of very long piles which are driven deeply into the seafloor. As an acid in driving these piles, a structure known as a jacket is used. The jacket is a structure containing a plurality of hollow pile sleeves. The pile sleeves serve as guides for driving the piles. The piles are lowered through the sleeves down to the seafloor and are driven into the seafloor. The jacket assures that each pile will be properly placed with respect to one another. In many offshore structures, the piles extend upward, through and beyond the sleeve to a point above the water's surface where they act as a stationary "island" for directly supporting the work deck. In some offshore structures, the work deck may be supported indirectly by the piles, the work deck being attached to members which are in turn attached to the pile sleeves. The piles are usually attached to the pile sleeves by grouting the outer surface of the pile to the inner surface of the pile sleeve. In addition to the pile sleeves, a jacket contains many horizontal, vertical and diagonal members which ultimately serve to provide support for the piles against lateral loads.

Almost all offshore jackets are constructed onshore. After construction has been completed, the jacket is towed to the drilling site and lowered to the proper position on the seabed. Some offshore areas have a very soft, unconsolidated seafloor. An excellent example of this is the Gulf of Mexico around the mouth of the Mississippi River.

The unconsolidated nature of this deltaic area presents challenging problems related to jacket installation. After the jacket has been lowered to the seafloor, it is very difficult to perform the pile driving operations. This difficulty arises from the fact that during the driving of a pile, the jacket tends to sink into the soft mud on that side of the jacket immediately surrounding the pile which is being driven. The tendency to sink can be understood, perhaps, by thinking of an inflated, doughnut-shaped rubber tube which is floating on water. (In this analogy, the tube represents the jacket and the water represents the unconsolidated seafloor). If a weight is placed on one side of the tube (in our analogy, the side of the jacket where the pile driving operation is occurring), that side of the tube sinks down and the other side of the tube tends to come up.

The above described difficulty involving the unconsolidated seafloor has been alleviated in the past by equipping the jacket bottom with devices which are commonly called mudmats. Mudmats are to these offshore structures what snowshoes are to man. These mudmats have a very large area, and, distributing the load of the jacket over said large area, allow the jacket to stand on the soft bottom and provide stability during pile driving operations.

Mudmats, however, in helping to solve this problem have created another problem. Occasionally, the unconsolidated sea bottom shifts position. This shifting creates huge mudslides which move along the bottom of the seafloor and crash into the jacket and the mudmats. The mudmats, having a very large area, are subjected to the tremendous forces exerted by the mudslides. Because the mudmats are attached to the jacket, the forces created by the mudslides are transferred to the jacket. This usually means that the jacket must be built to withstand such a mud load, requiring larger structural members and hence a more expensive jacket. This increase in cost may make an otherwise marginally attractive venture uneconomical.

Currently, as an alternative to increasing the size of the jacket members, the mudmats are removed after jacket installation, i.e. pile driving operations, have been completed. Unfortunately, the typical mudmat is designed such that it is often very difficult and expensive to remove the mudmats from the jacket.

Conventional mudmat design involves attaching the mudmat to the jacket in a manner and location such that the upward vertical projection of the mudmat intersects one or more members of the jacket. Stated another way, the mudmat cannot be removed by lifting it vertically because there are jacket members located above it which would interfere with such an operation. A typical mudmat design is illustrated in U.S. Pat. No. 3,638,436 in FIG. 6, item 17. See also U.S. Pat. No. 3,592,012, FIG. 2, item 34.

Typical mudmat removal includes the use of divers who must be sent to the seafloor. Usually, the mudmat is first cut by the divers into smaller-sized pieces which are easier to handle. For the reasons described above, said pieces cannot be removed by lifting them vertically. Instead each piece must be pulled horizontally until its upward vertical projection is without the upward vertical of the jacket. After a particular piece of the mudmat has been pulled horizontally as described hereinabove, it is hoisted vertically, removing it from the seafloor. This procedure is repeated over and over again for every piece of the mudmat until all the pieces have been removed.

Obviously this method of removing the mudmat entails considerable expense in terms of the amount of diving time required for this job. Futhermore, there are additional costs involving equipment which must be employed on the seafloor to pull each piece of the mudmat horizontally prior to pulling it vertically.

SUMMARY OF THE INVENTION

The disclosed invention overcomes much of the expense involved in the removal of mudmats by providing a mudmat design and removal procedure which, in combination with a particular jacket design, eliminates the need for cutting the mudmat into pieces and eliminates the need for pulling said mudmat pieces horizontally prior to pulling them vertically off the seafloor.

The invention provides a removable mudmat for supporting a jacket on a soft, unconsolidated seafloor during installation of said jacket to the seafloor. The mudmat comprises a bearing plate, framing members which are attached to and provide support for said bearing plate and means for removably attaching the framing members to the jacket.

The invention further provides a method of supporting a jacket on a soft, unconsolidated seafloor during installation of said jacket to the seafloor. The method comprises the steps of attaching at least one mudmat to said jacket prior to the installation of the jacket to the seafloor, detaching said mudmat from the jacket after the installation of the jacket, attaching at least one lifting cable to the mudmat, and lifting the entire mudmat off the seafloor in one piece by pulling generally vertically on the lifting cable.

The invention is designed to be used in combination with a jacket having 1 center pile sleeve and 4 corner pile sleeves, and in which 2 adjacent corner pile sleeves define one side of the jacket, 2 sides of the jacket having jacket legs interposed between the adjacent corner pile sleeves and the other 2 sides of the jacket having horizontal-diagonal members running inwardly from the corner pile sleeves toward the center of the jacket, said horizontal-diagonal members intersecting each other.

BEST MODE FOR CARRYING OUT THE INVENTION

Figure 1:
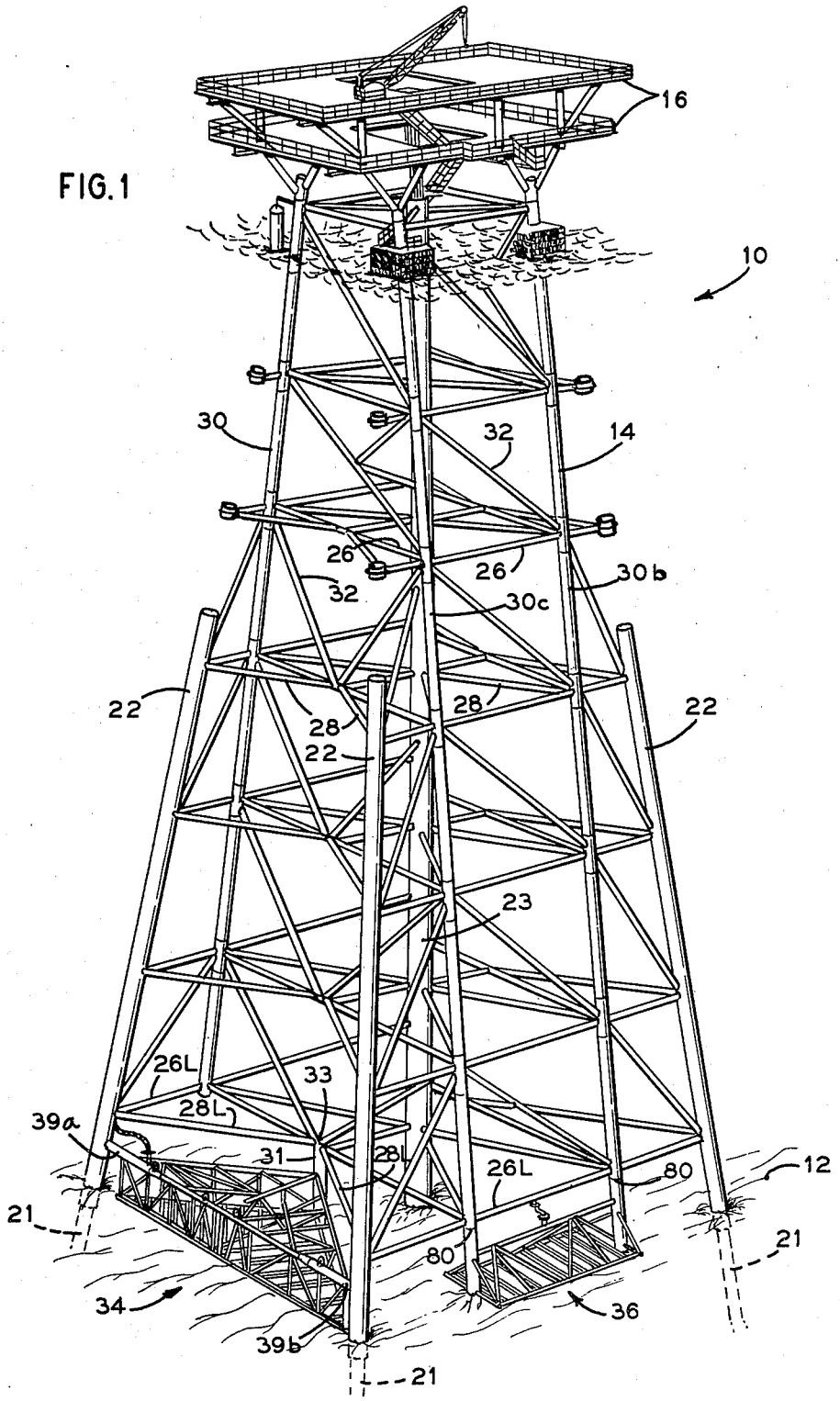
FIG. 1 is a perspective view of the jacket standing on the seafloor with the mudmats in position.

FIG. 1 shows a perspective view of an offshore structure 10 in position on the seafloor 12. The structure 20 has a jacket 14 and one or more decks 16. The jacket 14 includes corner pile sleeves 22 through which piles 21 are driven deeply into the seafloor. After the pile driving operations have been completed, the piles are permanently affixed to the interior of said pile sleeves through standard grouting procedures.

The jacket also includes a plurality of jacket members which ultimately provide lateral support for the piles (via the pile sleeves 22) and vertical support for the deck 16. Said jacket members include horizontal members 26 and horizontal-diagonal members 28. Horizontal members 26 are defined as jacket members which are situated in a generally horizontal plane and extend in a direction that is generally either parallel with or perpendicular to a line connecting two adjacent corner pile sleeves. Horizontal-diagonal members 28 are defined as jacket members which are situated in a generally horizontal plane and which are not horizontal members 26 as defined immediately above. Members 26 and 28 are located in and define levels of horizontal framing. For example, members 26L and 28L are located in the lowermost level of horizontal framing.

The jacket members also include jacket legs 30. The jacket shown in FIG. 1 has 4 such jacket legs, each jacket leg 30 extending from a point above the surface of the water to a point 80 located slightly below the lowermost level of horizontal framing. Two adjacent jacket legs define what is commonly called a vertical framing section, although some of the vertical framing sections, e.g. the one defined by legs **30*c* and 30*b*, are not truly vertical. Diagonal jacket members located in the plane of a vertical framing section are known as vertical-diagonal members 32**.

Figure 3:
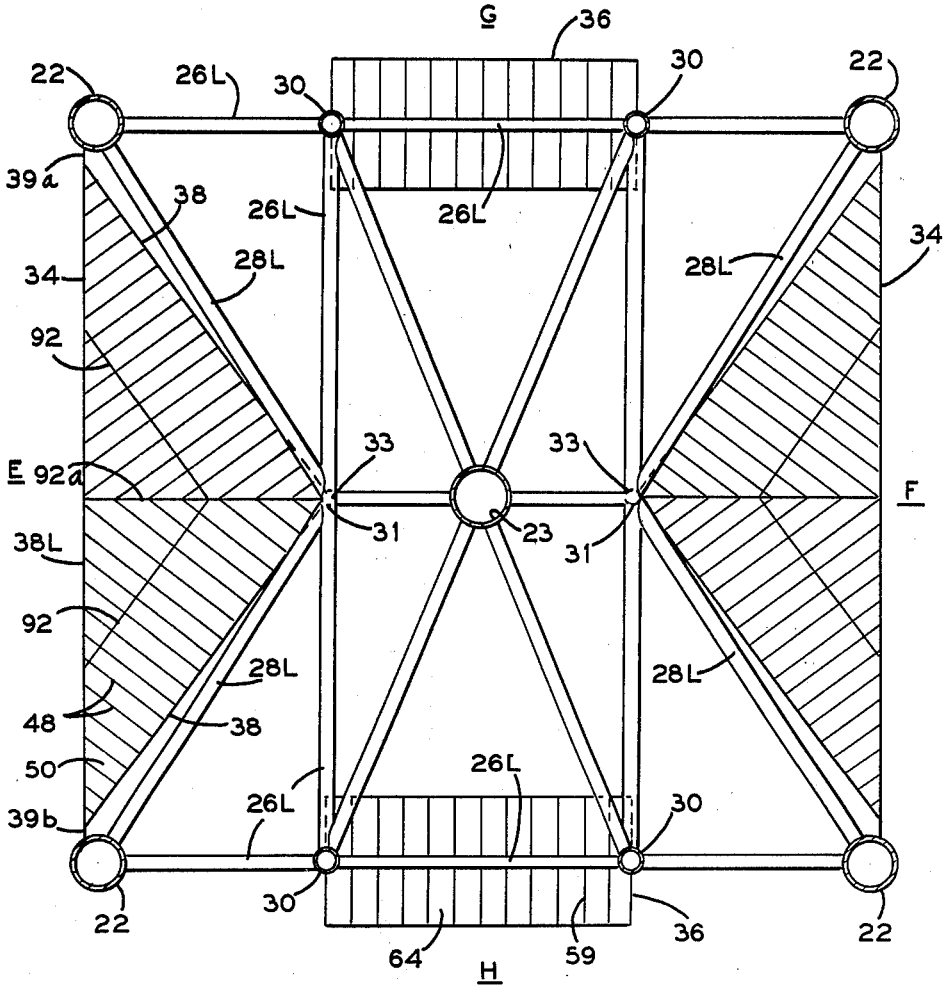
FIG. 3 is a plan view of the lowermost level of horizontal framing showing the position of the mudmats in relation to said framing.
Figure 4:
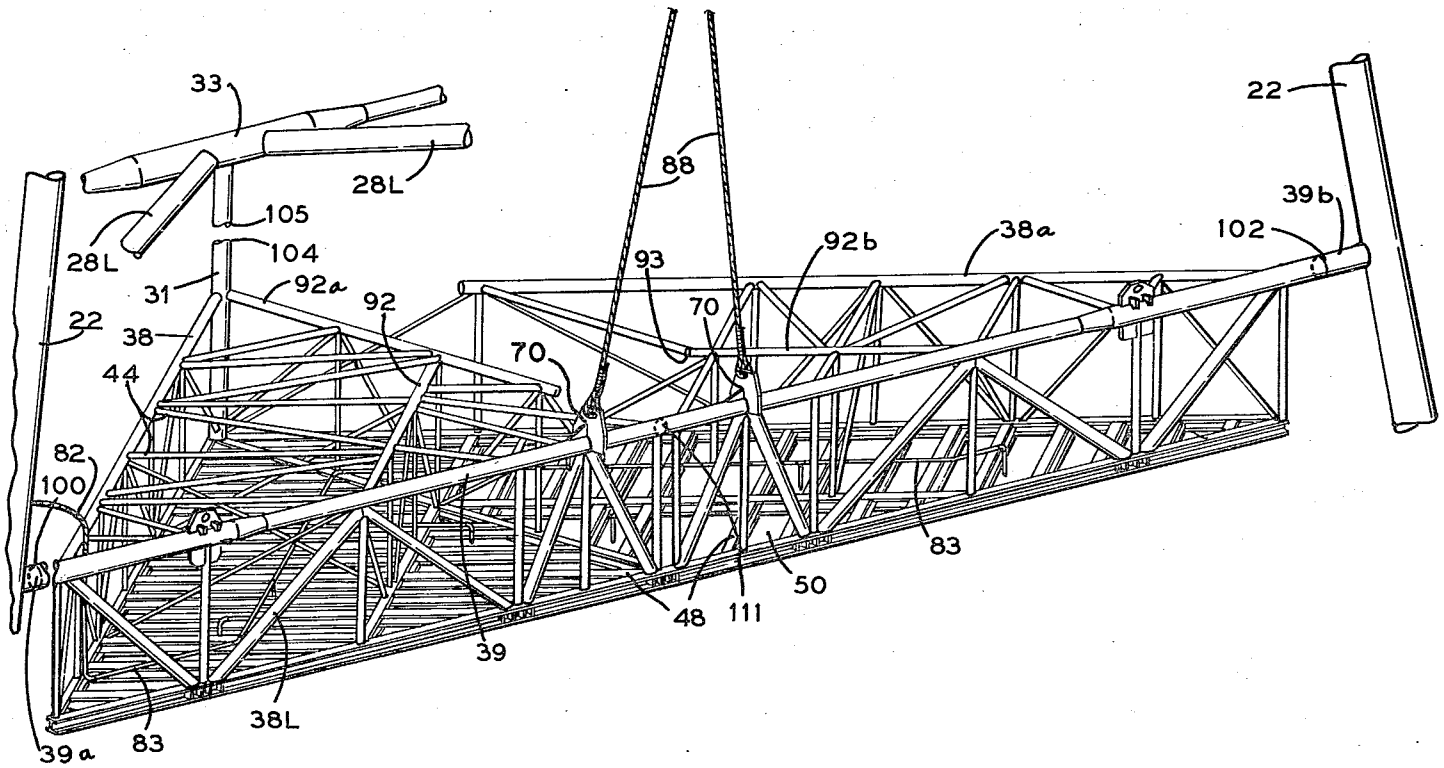
FIG. 4 is a perspective view of a mudmat.

Located near the bottom of the jacket are mudmats 34 and 36. Said mudmats are comprised of framing members which are attached to and provide support for a bearing plate. The framing members of said mudmats include trusses and beams which extend between the bottom chords of said trusses. As shown in FIGS. 3 and 4, the framing members of mudmat 34 include a plurality of peripheral, vertically disposed trusses 38 which form the outline of a triangle. Truss 38L is the longest of said trusses and is situated generally parallel to a line drawn between the two corner pile sleeves 22 which are located on opposite ends of mudmat 34. The mudmat framing members also include a plurality of interior trusses 92. A plurality of braces 44, illustrated in FIG. 4, provide lateral support for trusses 38 and 92.

As shown in FIG. 4, the top chords of some of the trusses of mudmat 34 do not extend the full length of their respective trusses, as for example, the top chords of trusses **92*a*, 92*b* and 38*a*. One end of each of said top chords remains unattached. This feature of being unattached contributes to the folding action of mudmat 34** during the lifting procedure as will be explained later.

Attached to and extending between the bottom chords of trusses 38 and 92 is at least one and preferably a plurality of beams 48. Attached to the bottom of and spanning across beams 48 is bearing plate 50. Bearing plate 50 could be one single plate or, in the alternative, it could be a group of contiguous plates which are welded together or a group of spaced plates. The bottom surface of plate 50 bears against the seafloor 12 during jacket installation. The mudmat framing members mentioned above, i.e. trusses 38, trusses 92, braces 44, and beams 48, provide a structural framework which supports and strengthens plate 50.

The mudmat framing members are removably attached to the jacket 14 by a plurality of extension members. Said extension members, which extend from some of the mudmat framing members, are designed to be severed after jacket installation has been completed. This severing action detaches the framing members (and hence the plate which is attached to the framing members) from the jacket 14. The extension members include upwardly disposed post 31 depicted in FIGS. 1 and 4. Said post is located at the apex of mudmat 34 and extends vertically beyond truss 38. Other extension members include members **39*a* and 39*b* which are extensions of the top chord 39 of truss 38L. (See FIGS. 1, 3 and 4.) Extension members 39*a* and 39*b* are attached at their respective ends to adjacent corner pile sleeves 22 which are located on opposite ends of mudmat 34. The top of post 31 is attached to the point of intersection 33 of horizontal-diagonal members 28L. Said members 28L extend inwardly from the corner pile sleeves 22 to which members 39***a* and 39*b* are attached and which are located on opposite ends of mudmat 34.

Mudmat 34 is detached from the jacket by making the cuts shown at 100, 102 and 104 in FIG. 4. An additional cut, 105, is also made on post 31 for reasons which will be explained later. It should be understood that cuts 104 and 105, which are made through post 31, do not weaken the structural integrity of the jacket because said post does not function as a load carrying member of the installed jacket.

Figure 5:
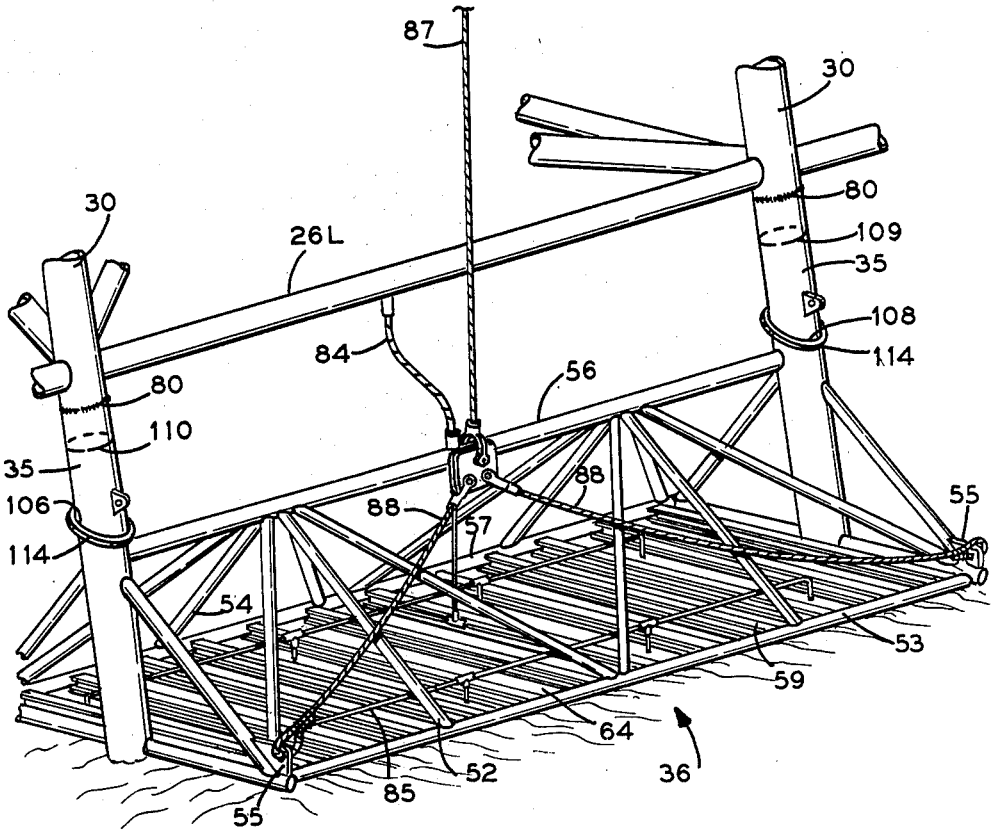
FIG. 5 is a perspective view of another mudmat.

Mudmat 36 is comprised of framing members which are attached to and provide support for a bearing plate. As depicted in FIG. 5, said framing members include angularly disposed trusses 52 and 54, said trusses having a common upper chord 56. Extending between the bottom chords of said trusses is at least one and preferably a plurality of beams 59. Attached to the bottom of and spanning across beams 59 is bearing plate 64 which serves the same function as plate 50 of mudmat 34.

The framing members described above, i.e. trusses 52 and 54, and beams 59 provide a structural framework which supports and strengthens plate 64.

The framing members of mudmat 36 are removably attached to the jacket 14 by at least one and preferably two extension members which are depicted in FIG. 5 as upwardly disposed posts 35. Said posts, extending respectively from beams 59, are located at opposite ends of bearing plate 64. Said bearing plate is generally symmetrical about a line connecting the bottom ends of said posts.

The upper end of each post 35 is attached respectively to the bottom 80 of jacket legs 30. The center line of post 35 is generally coincident with the centerline of jacket leg 30. Posts 35 are designed to be severed after jacket installation has been completed in order to detach the framing members of mudmat 36 (and hence attached plate 64) from jacket 14.

Mudmat 36 is detached from the jacket by making the cuts on posts 35 shown at 106 and 108. Two additional cuts, 109 and 110, are also made on posts 35 for reasons which will be explained later. Cutting guides 114 may be provided to aid the divers in makings the required cuts. Cuts 106, 108, 109 and 110 will not affect the structural integrity of the jacket because, similar to post 31, posts 35 do not function as load carrying members of the installed jacket.

In the preferred embodiment of the invention, two of each type of the mudmats described hereinabove are used on opposite sides of the jacket as shown in FIG. 3, i.e. mudmat 34 is used on sides E and F and mudmat 36 is used on sides G and H. The mudmats are preferably used in combination with the type of jacket shown in FIGS. 1.

Said jacket is commonly called a 5 pile jacket, there being four corner pile sleeves 22, and one center pile sleeve 23. The four corner pile sleeves 22 are angularly disposed toward one another in "pyramid" fashion. The center pile sleeve 23 is vertical and serves as the conduit through which oil and gas wells are drilled. Two adjacent corner pile sleeves 22 define one side of the jacket, there being a total of four sides. On two sides of the jacket, namely sides G and H, jacket legs 30 are interposed between the corner pile sleeves defining said sides. On the other two sides of the jacket, namely E and F, there are no jacket legs interposed between the adjacent corner pile sleeves. Instead, sides E and F have horizontal-diagonal members 28 running from the adjacent corner pile sleeves which define said sides. Said horizontal-diagonal members 28 run from said corner pile sleeves and are inwardly disposed toward the center of the jacket, intersecting at point 33.

As shown in FIGS. 1 and 3, except for a very small area of plate 50 immediately surrounding post 31, the upward vertical projection of plate 50 does not intersect any part of the jacket 14. Stated another way, the upward vertical projection of plate 50 is virtually without the upward vertical projection of jacket 14. This fact underlies one of the important advantages of this invention, i.e. mudmat 34 can be removed in one piece by a single, vertical lift. It is not necessary to pull mudmat 34 horizontally prior to lifting it off the seafloor and the mudmat can be lifted in one piece.

Mudmat 34 is ready to be lifted after cuts 100, 102, 104 and 105 have been completed. (See FIGS. 4 and 6.) Lifting cables are lowered from a barge or some other structure at the surface of the water down to mudmat 34. Said lifting cables are attached to the framing members of said mudmat by means of lifting eyes 70. Two lifting eyes are preferably located on top chord 39 of truss 38L, the lifting eyes being positioned on opposite sides of a line which is generally coincident with the top chord of truss 92*a*.

Figure 6:
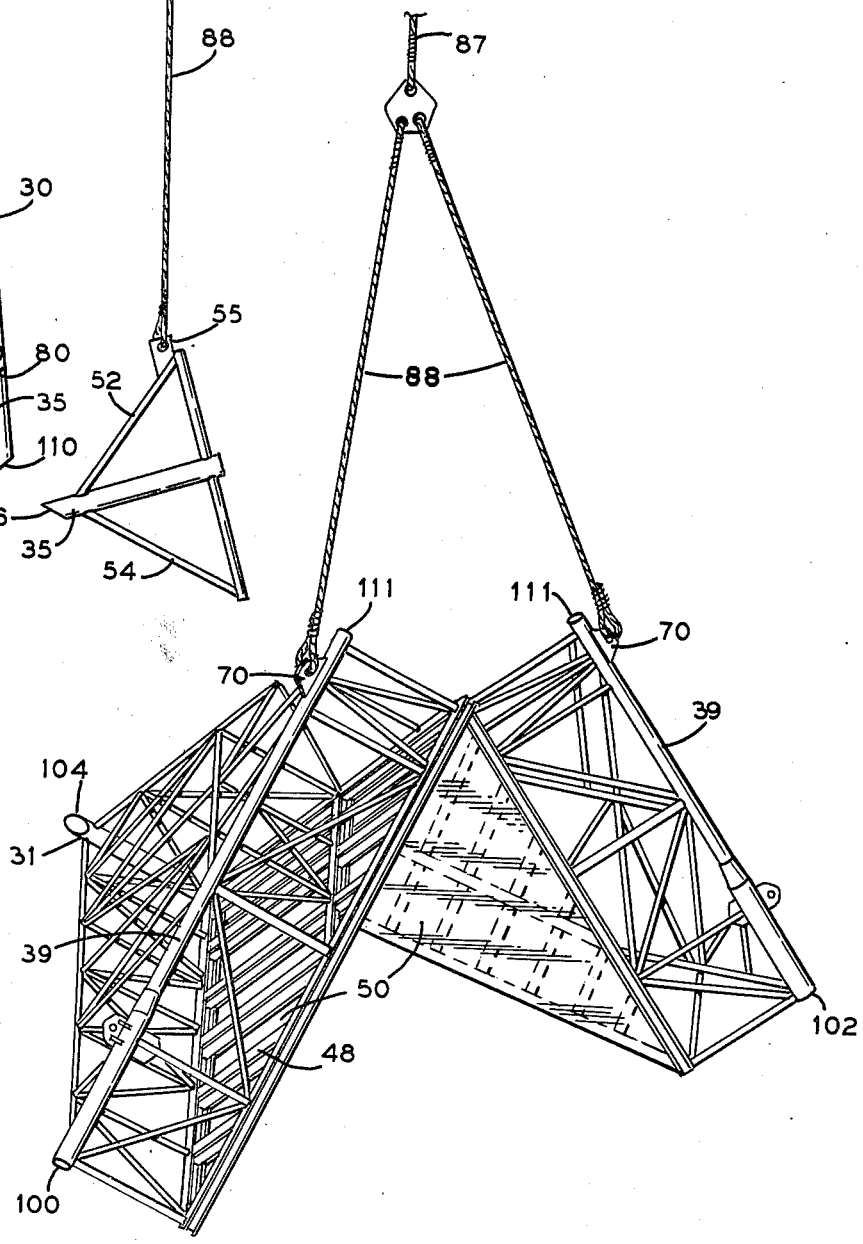
FIG. 6 is a perspective view of the mudmat shown in FIG. 4 after it has been detached from the jacket and lifted clear of the seafloor.

In the preferred embodiment of the invention, as shown in FIG. 6, one lifting cable 87 may be used which has a bridle 88 attached at its end, each end of the bridle being respectively connected to a lifting eye 70. Lifting force is provided by a winch or some other reeling mechanism located on the barge which creates tension in the cable.

As the tension is applied and gradually increased, flooding hose 82 (depicted in FIG. 4) is employed to direct a stream of water to the bottom surface of plate 50 via a network of tubular conduits 83. This helps reduce the suction forces which resist the lifting of the mudmat. During the entire lifting operation, the cable is maintained in a generally vertical position. Because of the location of lifting eyes 70, the area of bearing plate 50 located nearest truss 38L will be the first part of the mudmat to be lifted off the seafloor. Further lifting causes the flood line to break, its function by that time having already been completed. Continued lifting will cause the apex of the triangular shaped mudmat, i.e. the area near post 31, to move outwardly away from the center of the jacket, along the seafloor, until it too has been lifted off the seafloor. At this point all of mudmat 34 is off the seafloor.

During this lifting procedure, a certain amount of clearance must be provided at cut 104 so that the apex of the mudmat can break loose from the jacket unencumbered by that part of post 31 which will remain attached to the jacket. This clearance is assured by making cut 105. The combination of cuts 104 and 105 results in the removal of a segment of post 31. This segment is discarded.

As described above, the area of mudmat 34 located near post 31 is the last part of said mudmat to be lifted off the seafloor. When it has been lifted completely off the seafloor, mudmat 34 is hanging with its apex pointing in a generally downward direction. In this orientation, the upward vertical projection of the mudmat is entirely without the upward vertical projection of the jacket. The mudmat can then be hoisted to the surface, there being no jacket members to impede its vertical movement.

In one embodiment of mudmat 34, there is an additional cut 111 made on the top chord 39 of truss 38L at a point located between the lifting eyes. This cut encourages the mudmat to fold, as shown in FIG. 6, roughly along the bottom chord of truss 92*a* as the mudmat is being pulled off the seafloor. This folding action helps to overcome the suction forces resisting the removal of the mudmat. Said folding action results in two smaller, triangular shaped mudmats which have a common side, said common side being that part of plate 50 located beneath and along the bottom chord of truss 92*a*. The folded position reduces the changes of entanglement with the jacket as the mudmat is being pulled to the surface.

The folding action of mudmat 34 is further encouraged by the fact that the top chords of some of the trusses are unattached at one end, as was described earlier. To explain this by way of an example, assume that the top chord of truss 92*b*, instead of ending at point 93, extended the full length of truss 92*b* and was attached to truss 92*a*. In such a situation, the top chord of truss 92*b* would either have to be cut or fail in tension during the lifting procedure in order to accomplish the folding action described above. By leaving said chord unattached, the time and expense of severing the chord is eliminated.

Unlike mudmat 34, a large portion of mudmat 36 is located beneath members of the jacket. As shown in FIGS. 1, 3 and 5, horizontal member 26L is positioned directly above mudmat 36, a fact which may seem to make it necessary to pull mudmat 36 horizontally away from the jacket prior to lifting it vertically from the seafloor. However, removal of mudmat 36, in one piece, by a single vertical lift is possible as will be explained immediately below.

Referring to FIG. 5, lifting eyes 55 are located near bottom chord 53 of truss 52. Since truss 52 is situated further from the center of the jacket than truss 54, the lifting eyes are therefore located near the edge of mudmat 36 which is most distant from the center of the jacket. The ends of bridle 88 can then be secured to the lifting eyes. Cuts 106 and 108 are made which detach mudmat 36 from the jacket. Cuts 110 and 109 are also made for reasons which are analogous to cut 105 which was made on member 31 of mudmat 34.

Throughout the entire lifting operation of mudmat 36, the lifting cable 87 is kept in a generally vertical orientation. Flooding hose 84 and tubular conduits 85 may be employed in the lifting of mudmat 36 in the same way that flooding hose 82 and conduits 83 are used with mudmat 34.

Figure 2:
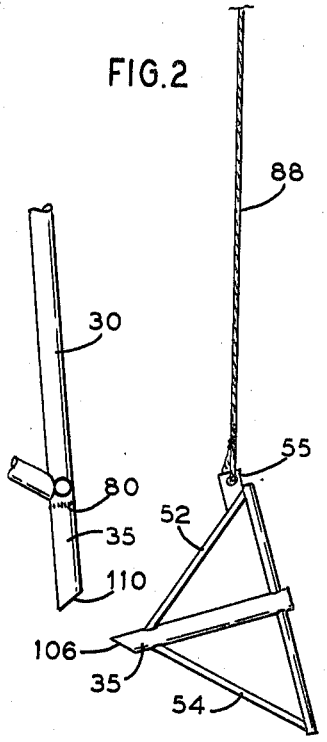
FIG. 2 is a partial elevation view of the mudmat shown in FIG. 5 after it has been detached from the jacket and lifted clear of the seafloor.

As tension is applied to the cable, the first part of mudmat 36 to be lifted off the seafloor will be the area around chord 53. As the lifting continues, the bottom chord 57 of truss 54 will drag along the seafloor, outwardly away from the center of the jacket. Finally, all of mudmat 36 will be free from the seafloor. At this point, mudmat 36 will be hanging roughly in the position shown in FIG. 2.

In such a position, the upward vertical projection of mudmat 36 is entirely without the upward vertical projection of the jacket. Mudmat 36 can then be hoisted to the surface, there being no jacket members to impede its vertical movement.

In one embodiment of the invention, the use of divers for detaching the mudmats from the jacket and attaching lifting cables to said mudmats is completely eliminated. Most jackets are constructed on land, laying on their sides, then barged to their offshore destination where they are lowered into the water. In said one embodiment, the lifting cables are attached to the mudmats prior to lowering the jacket into the water. Additional, remotely controlled explosive charges are placed around those members of the mudmat which are to be severed at the place where said members are to be severed. When activated, the explosive charge acts as the agent for severing said members. The lifting cables are then used to pull the detached mudmats to the surface.

While in accordance with the provisions of the statutes, there is illustrated and described herein specific embodiments of the invention, those skilled in the art will understand that changes may be made in the form of the invention covered by the claims, and certain features of the invention may sometimes be used to advantage without a corresponding use of the other features.

The embodiments of the invention in which an exclusive property or privilege is claimed are defined as follows:

1. In combination with a jacket having one center pile sleeve and four corner pile sleeves, and in which two adjacent corner pile sleeves define one side of the jacket, two sides of the jacket having jacket legs interposed between the adjacent corner pile sleeves and the other two sides of the jacket having horizontal-diagonal members running inwardly from the corner pile sleeves toward the center of the jacket—a removable mudmat for supporting said jacket on a soft unconsolidated seafloor during installation of said jacket to the seafloor, said mudmat comprising:

(a) a bearing plate;

(b) framing members which are attached to and provide support for said plate; and (c) means for removably attaching the framing members to the jacket.

2. The apparatus of claim 1 wherein said framing members include a plurality of trusses and wherein the top chord of at least one truss does not extend the full length of said truss.

3. The apparatus of claim 1 including means for attaching lifting cables to the framing members.

4. The apparatus of claim 1 wherein the means for removably attaching the framing members to the jacket include at least one extension member extending from a framing member, said extension member being severable in order to remove the framing members from the jacket.

5. The apparatus of claim 4 wherein said extension member is upwardly disposed and is attached at its upper end to the bottom of a jacket leg.

6. The apparatus of claim 5 wherein the center line of said upwardly disposed extension member is generally coincident with the centerline of the jacket leg to which it is attached.

7. The apparatus of claim 5 including two upwardly disposed extension members are described in claim 5 and wherein said upwardly disposed extension members are located on opposite ends of the bearing plate.

8. The apparatus of claim 7 wherein the bearing plate is generally symmetrical about a line connecting the bottom ends of said upwardly disposed extension members.

9. The apparatus of claim 4 wherein the framing members include:

(a) two diagonally disposed trusses which have a common top chord;

(b) at least one beam extending between the bottom chords of said trusses; and (c) wherein the bearing plate is attached to said beam.

10. The apparatus of claim 9 including at least one lifting eye located near the bottom chord of the truss which is situated furthest from the center of the jacket.

11. The apparatus of claim 4 wherein the upward vertical projection of the bearing plate is virtually without the upward vertical projection of the jacket.

12. The apparatus of claim 11 including two extension members which are respectively attached to two adjacent corner pile sleeves.

13. The apparatus of claim 12 wherein the framing members include three trusses which are attached to each other in such a way as to form the outline of a triangle, the longest truss being so situated that it is parallel to a line connecting the adjacent corner pile sleeves to which the extension members are respectively attached.

14. The apparatus of claim 13 wherein the horizontal-diagonal members of the jacket intersect and including an upwardly disposed extension member situated at the apex of the triangular outline, the top of said extension member being attached to the point of intersection of the two horizontal-diagonal members which extend from said adjacent corner pile sleeves.

15. The apparatus of claim 13 including at least one lifting eye located on the longest truss.

16. The apparatus of claim 13 including at least one beam extending between the bottom chords of said trusses and wherein the bearing plate is attached to said beam.

17. In combination with a jacket having one center pile sleeve and four corner pile sleeves, and in which two adjacent corner pile sleeves define one side of the jacket, two sides of the jacket having jacket legs interposed between the adjacent corner pile sleeves and the other two sides of the jacket having horizontal-diagonal members running inwardly from the corner pile sleeves toward the center of the jacket—a method of supporting said jacket on a soft, unconsolidated seafloor during installation of said jacket to the seafloor, said method comprising the steps of:

(a) attaching at least one mudmat to said jacket prior to the installation of the jacket to the seafloor;

(b) detaching said mudmat from the jacket after the installation of the jacket;

(c) attaching at least one lifting cable to the mudmat; and (d) lifting the entire mudmat off the seafloor in one piece by pulling generally vertically on the lifting cable.

18. The method of claim 17 wherein the step of attaching the lifting cables to the mudmat includes attaching said cables near the edge of the mudmat which is most distant from the center of the jacket.

19. The method of claim 17 in which the step of lifting the mudmat off the seafloor comprises:

(a) applying tension to the lifting cable until the side of the mudmat to which the cable is attached clears the seafloor;

(b) pulling very slowly on the lifting cable, allowing that part of the mudmat which is still on the seafloor to drag along the seafloor outwardly away from the center of the jacket until all of the mudmat is off the seafloor; and then (c) hoisting the mudmat to the surface.

20. The method of claim 17 wherein the step of attaching the mudmat to the jacket comprises:

(a) providing at least one extension tension member extending from the mudmat and (b) attaching said extension member to the jacket; and wherein the step of detaching the mudmat from the jacket comprises severing said extension member.

21. The method of claim 20 wherein the step of attaching the mudmat to the jacket includes providing two extension members at opposite ends of the mudmat and attaching the upper ends of said extension members respectively to the bottoms of two jacket legs.

22. The method of claim 21 including the additional step of severing each extension member a second time at a location spaced apart from the first severing operation.

23. The method of claim 20 wherein the horizontal-diagonal members of the jacket intersect and wherein the step of attaching the mudmat to the jacket comprises:

(a) providing two extension members;

(b) attaching said extension members respectively to adjacent corner pile sleeves;

(c) providing an additional extension member; and (d) attaching said additional extension member to the intersection of the two horizontal-diagonal members which extend from said adjacent corner pile sleeves.

24. The method of claim 23 including the additional step of severing said additional extension member a second time at a location spaced apart from where the first severing operation occurred.

25. The method of claim 17 wherein the step of attaching the lifting cable includes attaching said cable to the mudmat at two points and including the additional step of cutting the mudmat between said points of cable attachment prior to lifting said mudmat.

26. In combination with a jacket having one center pile sleeve and four corner pile sleeves, and in which two adjacent corner pile sleeves define one side of the jacket, two sides of the jacket having jacket legs interposed between the adjacent corner pile sleeves and the other two sides of the jacket having horizontal-diagonal members running inwardly from the corner pile sleeves toward the center of the jacket, said horizontal-diagonal members intersecting each other - a method of supporting said jacket on a soft, unconsolidated seafloor during installation of said jacket to the seafloor, said method comprising the steps of:

(a) providing, on each side of the jacket having jacket legs interposed between the adjacent corner pile sleeves, a mudmat having two upwardly disposed extension members and attaching the upper ends of said extension members respectively to the bottom of said jacket legs;

(b) providing, on each of the remaining two sides of the jacket, a mudmat having three extension members, attaching two of the extension members respectively to the adjacent corner pile sleeves, and attaching the third extension member to the intersection of the two horizontal-diagonal members which extend from said adjacent corner pile sleeves;

(c) attaching lifting cables to the mudmats;

(d) severing the extension members; and (e) lifting the mudmats off the seafloor, each in one piece, by pulling generally vertically on the lifting cables.

* * * * *